US007918659B2

(12) United States Patent
De Rango et al.

(10) Patent No.: US 7,918,659 B2
(45) Date of Patent: Apr. 5, 2011

(54) VACUUM PUMP FOR A VEHICLE WITH MULTIPLE ONE-WAY VALVES

(75) Inventors: Alessandra De Rango, Funo (IT); Giovanni Pazzi, Funo (IT); Angelo Pancotti, Funo (IT)

(73) Assignee: O.M.P. Officine Mazzocco Pagnoni, S.r.L., Funo (IT)

( * ) Notice: Subject to any disclaimer, the term of this patent is extended or adjusted under 35 U.S.C. 154(b) by 578 days.

(21) Appl. No.: 11/915,891

(22) PCT Filed: May 22, 2006

(86) PCT No.: PCT/IT2006/000380

§ 371 (c)(1),
(2), (4) Date: Mar. 10, 2008

(87) PCT Pub. No.: WO2006/129333

PCT Pub. Date: Dec. 7, 2006

(65) Prior Publication Data

US 2008/0199342 A1 Aug. 21, 2008

(30) Foreign Application Priority Data

May 30, 2005 (IT) ..... MI2005A1008

(51) Int. Cl.
*F01C 21/04* (2006.01)
*F04C 15/00* (2006.01)

(52) U.S. Cl. ..... 418/270

(58) Field of Classification Search ..... 418/270, 418/15

See application file for complete search history.

(56) References Cited

U.S. PATENT DOCUMENTS 3,809,511 A 5/1974 Hess
5,466,135 A * 11/1995 Draskovits et al. ..... 418/15
5,605,450 A * 2/1997 Edwards ..... 418/15
(Continued)

FOREIGN PATENT DOCUMENTS

DE 3819623 A1 * 7/1989
(Continued)

OTHER PUBLICATIONS

PCT International Search Report for PCT/IT2006/000380, Jul. 9, 2006.

*Primary Examiner* — Thomas E Denion
*Assistant Examiner* — Mary A Davis
(74) *Attorney, Agent, or Firm* — Robert C. Haldiman; Husch Blackwell LLP

(57) ABSTRACT

The invention relates to a vacuum pump (1) for vehicle motors, comprising a stator (2), a chamber defined within said stator (2) and at least one vane rotatably mounted inside said chamber so as to generate a depression. The stator (2) comprises inlet openings for air and oil, and a first discharge outlet (30) on which a first one-way valve operates (35). According to the invention, the stator (2) further comprises a second discharge outlet (50) separate from said first discharge outlet (30) and a second one-way valve (55) operating on said second discharge outlet (50). In this manner it is possible to separate the air discharge from the oil discharge, both physically and operationally. The invention further relates to a one-way valve for said vacuum pump. Such valve comprises a blade body (60) having a first blade which defines a first one-way valve (35) and at least one second blade which defines at least one second one-way valve (55).

11 Claims, 3 Drawing Sheets

U.S. PATENT DOCUMENTS 5,769,617 A * 6/1998 Glen ..... 418/270

FOREIGN PATENT DOCUMENTS

DE 4019854 A1 * 1/1991
DE 9311376 U1 * 9/1993
EP 0206154 A2 * 6/1986
GB 2107789 A * 5/1983
JP 2002371965 12/2002
JP 2004270453 9/2004

* cited by examiner

VACUUM PUMP FOR A VEHICLE WITH MULTIPLE ONE-WAY VALVES

CROSS-REFERENCE TO RELATED APPLICATIONS

This application claims priority from international application PCT/IT2006/000380 filed 22 May 2006 which claims priority to Italian application MI2005A001008 filed on 30 May 2005.

The present invention relates to a vacuum pump for vehicle motors. More specifically, the invention relates, preferably, but in a non-limiting manner, to a vacuum pump for the servo brake system of vehicle motors.

The invention also relates to a one-way valve for a such vacuum pump.

As is known, vehicle motors, for example heavy motor vehicles and/or high-powered automobiles, typically comprise a vacuum pump adapted to create a determined depression to activate and operate certain devices in a vehicle, such as for example, the servo brake.

Typically, a vehicle motor vacuum pump comprises a stator, a depression chamber defined within the stator, and a vane rotatably mounted inside the vacuum pump chamber in order to generate the desired depression. The vane is provided with opposite end portions in sealed contact with the internal surface of the stator.

In turn, the stator comprises inlet openings for air and lubrication oil, and a discharge opening for the air and oil.

The desired depression is obtained through the rotation of the vane in the vacuum pump chamber and through the simultaneous sealing action of the opposed vane ends on the internal surface of the stator. The air taken into the vacuum pump chamber from a pressurised tank at atmospheric pressure is pushed by the vane from a zone having a pre-determined volume, to a zone with a larger volume. In this manner the pressure of the air is reduced. The oil, as well as acting as a lubricant, contributes to create the sealing action between the opposite end portions of the vane and the internal surface of the stator during vane rotation.

A one-way valve operates on the discharge opening. In the solutions provided by the prior art, the one-way valve typically consists of a single blade pivoted on the external surface of the stator at the above-said discharge opening.

The one-way valve operates to perform the following functions:

- to guarantee the sealing action between the vacuum pump chamber and the external environment when the servo brake system is not in operation;
- to permit air discharge during braking action or when the servo brake system is in use;
- to permit lubrication oil discharge.

The Applicant has found a number of problems with the prior art solutions. Such problems are mainly due to the fact that the air and oil discharge have very different characteristics.

Air discharge occurs each time the one-way valve moves from the discharge opening, in other words, each time braking occurs or when the servo brake system is used. Air discharge must be performed in a time as short as possible in order to be able to immediately reset the desired depression in the servo brake system so that the system itself can afterwards be used again. For this reason the discharge opening and the one-way valve are dimensioned according to the amount of air to be discharged, in other words so as to ensure that the air is evacuated very rapidly.

On the other hand, the oil flow rate introduced into the vacuum pump chamber, especially at low regimes, is rather low, and in any case much lower than the amount of air to be discharged. Thus, at such regimes, oil is discharged in an intermittent manner. In fact, the oil is discharged only after enough oil has been accumulated in the vacuum pump chamber to generate, on the blade valve (which, as stated previously, is dimensioned according to the amount of air to be discharged) a pressure which is sufficient to move it thus opening the discharge opening. However in these conditions, the oil exits at very high pressures, causing considerable fatigue stress on the blade valve.

On the other hand, at high regimes, the oil flow rate is considerably greater. Thus, in this case, the oil discharge is performed continuously. Therefore, in these condition, the blade valve remains open all the time. Consequently, a direct airflow from the exterior into the vacuum pump chamber occurs. Such air introduced into the vacuum pump chamber through the discharge opening is subsequently compressed because of the vane rotation. This requires a certain mechanical effort. Therefore, in these conditions, a power absorption peak by the vacuum pump occurs.

The technical problem at the basis of the present invention is to overcome or at least reduce the disadvantages discussed above with reference to the prior art.

Therefore, in a first aspect thereof, the present invention relates to a vacuum pump for vehicle motors, comprising:

- a stator;
- a chamber defined inside the stator;
- at least one vane rotatably mounted inside said chamber and which can be operated to generate a depression;

wherein the stator comprises:

- at least one air inlet opening;
- at least one oil inlet opening;
- one first discharge opening;

the vacuum pump further comprising a first one-way valve operating on said first discharge opening;

the vacuum pump being characterised in that the stator comprises at least one second discharge opening, separate from said first discharge opening, and in that it comprises at least one second one-way valve operating on said at least one second discharge opening.

Advantageously, the present invention allows a physical and functional separation between the air discharge and the oil. discharge to be effected. More advantageously, according to the present invention, it is possible to dimension one of the discharge openings and the corresponding one-way valve according to the amount of air to be discharged, while the other discharge opening and the corresponding one-way valve are dimensioned according to the oil flow rate to be discharged (for example, according to the oil flow rate introduced into the vacuum pump chamber at each vane rotation). Therefore it is possible to arrange for the oil to be discharged continuously even at low regimes, thus preventing fatigue stress on the one-way valve. Therefore a less expensive material can be used than that employed for the vacuum pump blade valves of the prior art.

According to the present invention, during discharge, it is also possible to reduce (if not even eliminate) any possible reverse airflow into the vacuum pump, in this way considerably reducing (if not even eliminating) power absorption peaks, which typically occur with prior art solutions.

Preferably, said at least one second discharge opening is adjacent to said first discharge opening.

More preferably, said at least one second discharge opening is smaller in size than said first discharge opening.

In the preferred embodiment of the vacuum pump of the present invention, said at least one second discharge opening is dimensioned to discharge the corresponding oil flow rate introduced into the vacuum pump chamber at each vane rotation. In this manner the oil discharge is performed substantially continuously.

More preferably, said at least one second discharge opening has a size such that it is completely occupied by the oil flow rate discharged at each vane rotation. Therefore, during oil discharge, any reverse airflow from the exterior is prevented from entering the vacuum pump chamber, which, as specified previously with reference to the prior art, would provoke a power absorption peak by the vacuum pump. Instead, according to the present invention, power absorption by the vacuum pump results as being far more regular.

Preferably, said at least one second one-way valve is smaller in size than said first one-way valve. More preferably, said at least one second one-way valve is dimensioned according to the size of said at least one second discharge opening and/or to the oil flow rate introduced into the vacuum pump chamber at each vane rotation.

In a first embodiment of the vacuum pump of the present invention, said first and at least one second one-way valves are made in different materials.

In such embodiment, preferably, said at least one second one-way valve is made in a material having rigidity that is lower than that of the said first one-way valve material. Advantageously, a less expensive material can be used for the second one-way valve compared to that used for the first one-way valve.

More preferably, said at least one second one-way valve comprises a blade pivoted on an external surface of said stator at said at least one second discharge opening.

In the preferred embodiment of the vacuum pump of the present invention, said first one-way valve and said at least one second one-way valve are made in a single blade body pivoted on an external surface of said stator at said first and at least one second discharge openings, said blade body comprising a first blade defining said first one-way valve and at least one second blade defining said at least one second one-way valve.

Advantageously, the first blade of the blade body is specifically adapted to the air discharge and is dimensioned according to the amount of air to be discharged and/or according to the size of above-said first discharge opening, while the second blade of the blade body is specifically adapted to the oil discharge and is dimensioned according to the oil flow rate to be discharged (for example, the oil flow rate introduced into the vacuum pump chamber at each vane rotation) and/or according to said second discharge opening.

In a second aspect thereof, the present invention relates to a one-way valve for a vacuum pump for vehicle motors, comprising a blade body having a first blade adapted to define a first one-way valve and at least one second blade adapted to define at least one second one-way valve.

Advantageously, such one-way valve can be used in the vacuum pump of the present invention and therefore it is able to provide all the advantages stated previously in reference to such vacuum pump.

Preferably, said at least one second blade is smaller in seize than said first blade.

BRIEF DESCRIPTION OF THE DRAWINGS

Further characteristics and advantages of the present invention will be made clearer from the following detailed description of a preferred embodiment thereof, made with reference to the appended drawings. In these drawings.

DETAILED DESCRIPTION OF THE INVENTION

Figure 1:
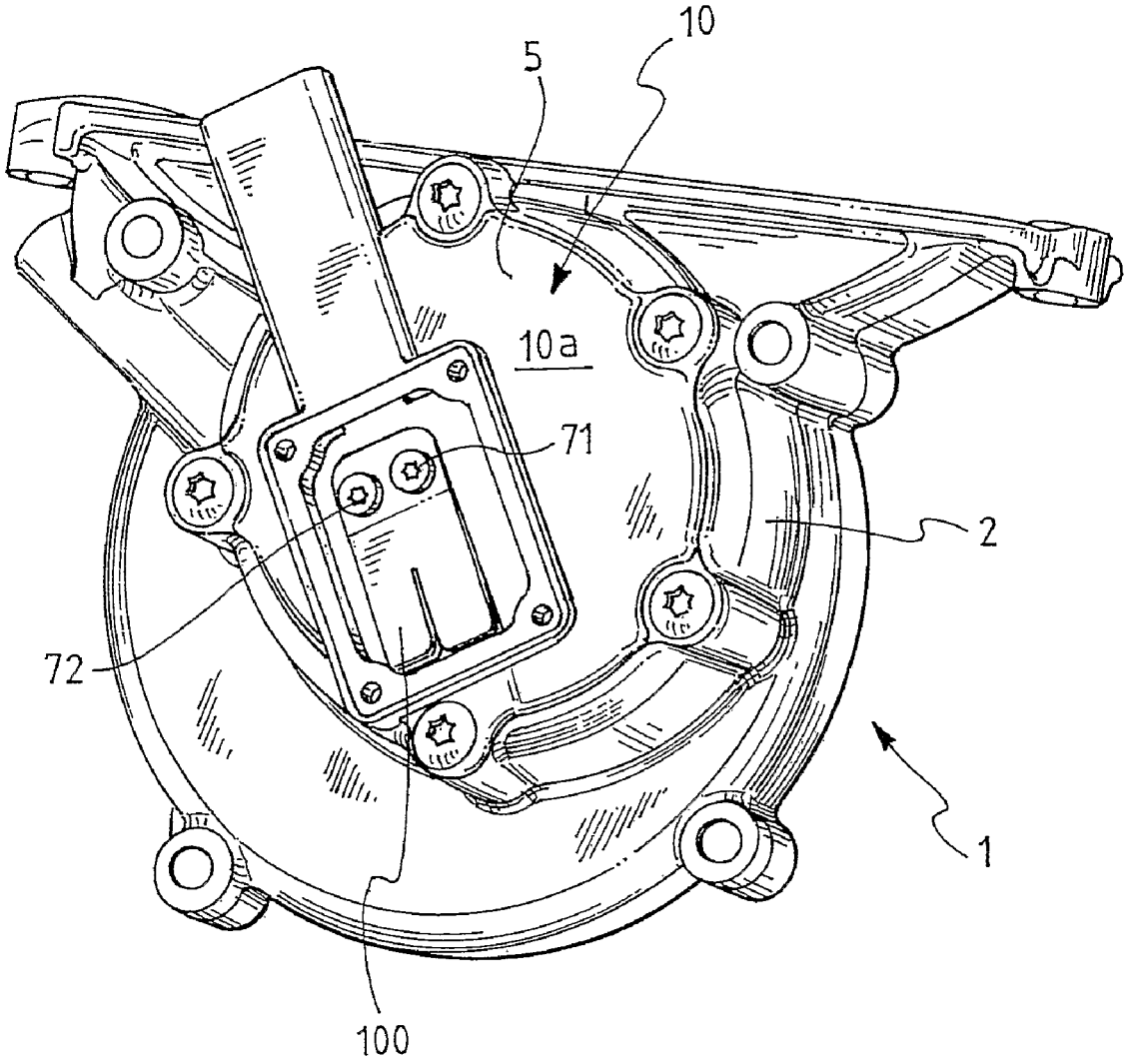
FIG. 1 is a schematic perspective view of a vacuum pump according to the present invention.

In the appended drawings, a vacuum pump according to the present invention is indicated with reference numeral 1.

Figure 2:
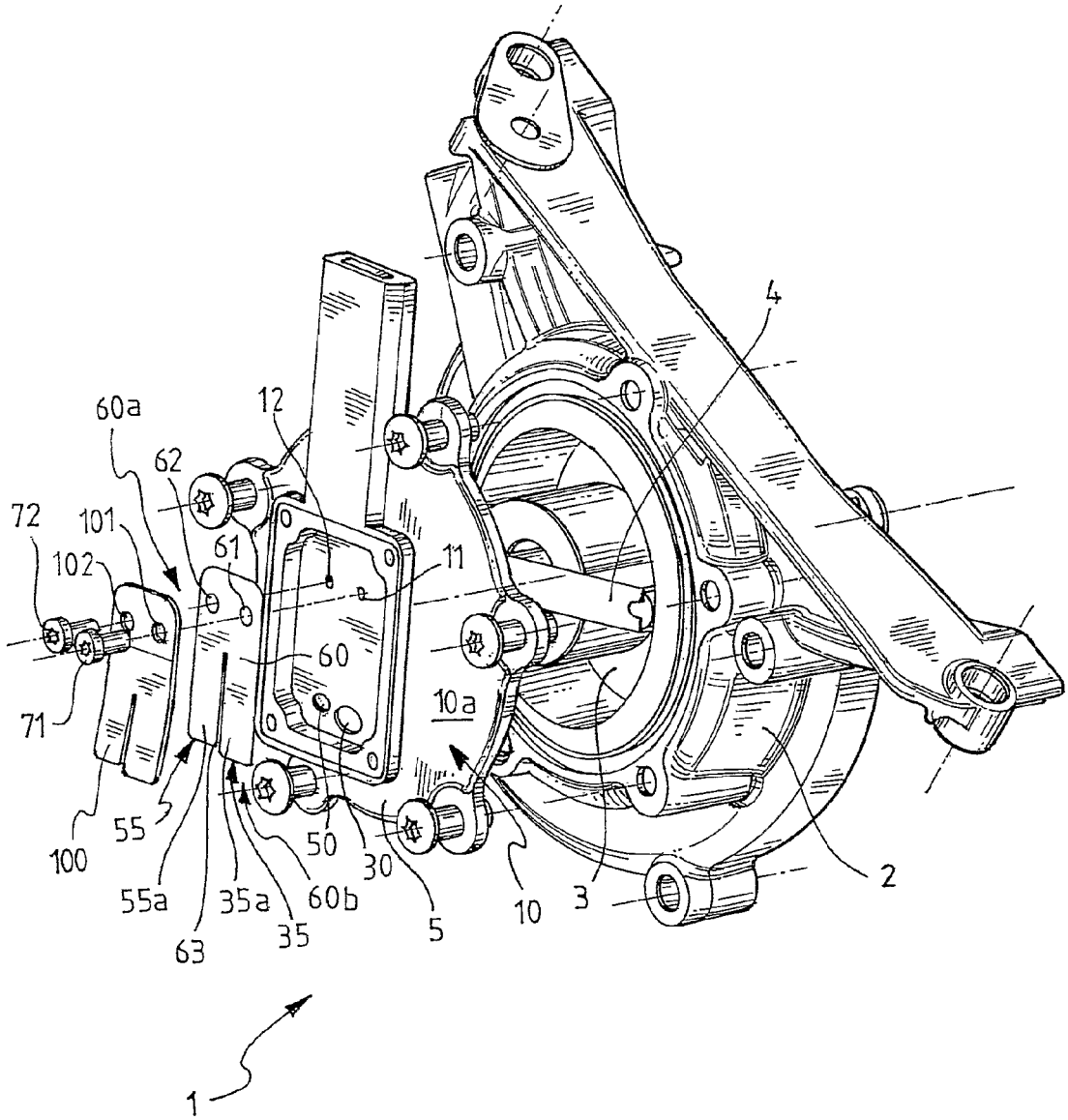
FIG. 2 is a schematic perspective and exploded view of the vacuum pump of FIG. 1.

The vacuum pump 1 comprises a stator 2 inside which is defined a chamber 3 in which a vane 4 is rotatably mounted (FIG. 2). The vane 4 is provided with opposed end portions in sealed contact with the internal surface of the stator 2 to create the desired depression.

In turn, the stator 2 comprises openings for air and oil entry (not shown since these are per se conventional and/or can be obtained by a man skilled in the art in any convenient manner) and a closing cover 5. As can be seen in FIG. 2, on a side surface 10 of the stator 2 defined by the cover 5 in the specific example illustrated herein, a first discharge opening 30 and a second discharge opening 50 are formed. The two discharge openings 30 and 50 are formed adjacent to one another and are sized differently. In particular, the first discharge opening 30 is larger in size than the second discharge opening 50.

The first discharge opening 30 is dimensioned according to the amount of air to be discharged, while the second discharge opening 50 is dimensioned according to the oil flow rate to be discharged. In particular, the second discharge opening 50 is dimensioned so that, at each rotation of vane 4, the corresponding oil flow rate introduced into the vacuum pump 1 chamber 3 is discharged, and so that, during such discharge, the discharge opening 50 is completely occupied by the discharged oil flow rate.

The vacuum pump 1 further comprises a first one-way valve 35 at the first discharge opening 30 and a second one-way valve 55 at the second discharge opening 50.

The first one-way valve 35 and the second one-way valve 55 are made to form a single blade body 60 (for example, manufactured from steel for springs) pivoted, at an upper portion 60*a* thereof, on the external surface 10*a* of the side surface 10 of the vacuum pump 1 by means of specific screws 71, 72 associated with respective holes 61, 62 formed on the blade body 60 and with respective holes 11, 12 formed on the external surface 10*a* of the side surface 10 of the vacuum pump 1. The blade body 60 comprises, at a lower portion 60*b* thereof, a longitudinal slot 63 extended along a portion of the length of the blade body 60 itself. Such slot 63 divides the lower portion 60*b* of the blade body 60 into two separate blades 35*a* and 55*a* of different sizes. The larger sized blade 35*a* forms the first one-way valve 35 while the smaller sized blade 55*a* forms the second one-way valve 55.

The larger sized blade 35*a* is therefore specifically adapted to the air discharge, and is dimensioned according to the amount of air to be discharged and/or according to the size of the first discharge opening 30, while the smaller sized blade 55*a* is specifically adapted to the oil discharge and is dimensioned according to the oil flow rate to be discharged (which corresponds with the oil flow rate introduced into the vacuum pump 1 at each vane rotation) and/or according to the second discharge opening 50.

The vacuum pump further comprises a stop element 100 made in a material more rigid than that of the blade body 60 (such as common steel for example) and adapted to control the opening of the blades 35*a*, 55*a*. The stop element 100 has holes 101 and 102 intended to be aligned with the holes 61 and 62 of the blade body 60 and with the holes 11 and 12 of the side surface 10 of the stator 2 to permit the fastening of such stop element 100 to the external surface 10*a* of the side surface 10 of the stator 2 by means of the screws 71 and 72. In the illustrated example, such stop element has an identical shape to that of the blade body 60, but it can assume different shapes in alternative embodiments.

Figure 3:
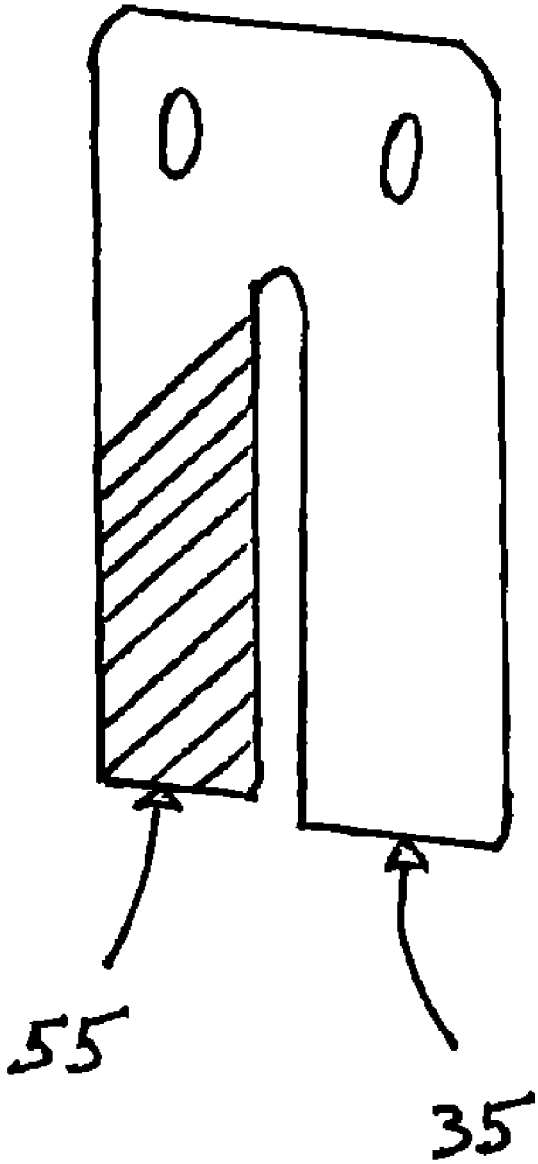
FIG. 3 is a schematic showing different materials for the first and second valve.

In an alternative embodiment shown in FIG. 3, the first one-way valve 35 and the second one-way valve 55 are made as two separate bodies, possibly made from different material. In this case, the two valves can assume a different configuration from the blade one described previously. The man skilled in the art will understand that any type of conventional one-way valve can be used.

In the case where valves of the blade type pivoted on the external surface 10*a* of the side surface 10 of the stator 1 at the respective discharge openings 30, 50 are used, the second one-way valve 55 could be made in a less expensive material compared to that of the first one-way valve 35, such as for example a material with less rigidity than that of the material used for the first one-way valve 35.

In operation, when the braking system is not in use, and once the desired compression has been created, the first one-way valve 35 remains permanently closed.

When braking action occurs, or when the servo brake system is in use, the first one-way valve 35 is opened and the air is discharged outside the vacuum pump 1 through the first discharge opening 30.

On the other hand, the second one-way valve 55 is mainly always open, but this does not provoke any power absorption peaks by vacuum pump 1.

Therefore a strong reduction of the peaks of the power absorbed by the vacuum pump 1 even during high regimes as well as an increase in valve reliability, which valves are less subject to stress thanks to the distribution of stresses generated by the air and oil.

A further advantage that is obtained by the present invention is the fact that it facilitates the discharge of the lubrication oil during minimum motor action, during motor switch-on. In fact, in this case, all the oil accumulated in the vacuum pump 1 when the motor is switched off can be advantageously discharged in a very short time by using both discharge openings 30, 50. This results as being particularly advantageous in cold climates, when the accumulated oil tends to become viscous and its removal provokes a peak in absorbed power by the vacuum pump 1, as well as considerable stresses on the one-way valve.

The invention claimed is:

1. A vacuum pump for an engine, comprising:

a stator;

a chamber defined within said stator;

at least one air inlet opening in said stator to said chamber;

at least one oil inlet opening in said stator to said chamber;

a first discharge opening in said stator to said chamber;

at least one vane rotatably mounted inside said chamber, said vane being operable to generate a depression;

a first one-way valve operating on a first discharge opening;

at least one second discharge opening separate from said first discharge opening and at least one second one-way valve operating on said at least one second discharge opening;

said at least one second discharge opening being dimensioned to discharge the corresponding oil flow rate introduced into said chamber at each rotation of said vane; and said at least one second discharge opening having a size such that it is completely occupied by the oil flow rate discharged at each rotation of said vane.

2. The vacuum pump according to claim 1, wherein said at least one second discharge opening is adjacent to said first discharge opening.

3. The vacuum pump according to claim 1, wherein said at least one second discharge opening is smaller in size than said first discharge opening.

4. The vacuum pump according to claim 1, wherein said at least one second one-way valve is smaller in size than the said first one-way valve.

5. The vacuum pump according to claim 1, wherein said at least one second one-way valve is dimensioned according to the dimensions of said at least one second discharge opening.

6. The vacuum pump according to claim 1 wherein said first and at least one second one-way valves are made in different materials.

7. The vacuum pump according to claim 1, wherein said at least one second one-way valve is made in a material being less rigid than the material of said first one-way valve.

8. The vacuum pump according to claim 1, wherein said at least one second one-way valve comprises a blade pivoted on an external surface of said stator at said second discharge opening.

9. The vacuum pump according to claim 1, wherein said first one-way valve and said at least one second one-way valve are made in a single blade body pivoted on an external surface of said stator at said first and at least one second discharge openings, said blade body comprising a first blade defining said first one-way valve and at least one second blade defining said at least one second one-way valve.

10. A vacuum pump for engine, comprising:

a stator;

a chamber defined within said stator;

at least one air inlet opening in said stator to said chamber;

at least one oil inlet opening in said stator to said chamber;

a first discharge opening in said stator to said chamber;

at least one vane rotatably mounted inside said chamber, said vane being operable to generate a depression;

a first one-way valve operating on a first discharge opening;

at least one second discharge opening separate from said first discharge opening and at least one second one-way valve operating on said at least one second discharge opening;

wherein said first and at least one second one-way valves are made in different materials.

11. A vacuum pump for engine, comprising:

a stator;

a chamber defined within said stator;

at least one air inlet opening in said stator to said chamber;

at least one oil inlet opening in said stator to said chamber;

a first discharge opening in said stator to said chamber;

at least one vane rotatably mounted inside said chamber, said vane being operable to generate a depression;

a first one-way valve operating on a first discharge opening;

at least one second discharge opening separate from said first discharge opening and at least one second one-way valve operating on said at least one second discharge opening;

wherein said at least one second one-way valve is made in a material being less rigid than the material of said first one-way valve.

* * * * *